US005320194A

United States Patent [19]

Bredijk

[11] Patent Number: 5,320,194

[45] Date of Patent: Jun. 14, 1994

[54] ADJUSTABLE ROOFING SCAFFOLD APPARATUS

[76] Inventor: Dennis Bredijk, P.O. Box 1292, Brick, N.J. 08723

[21] Appl. No.: 88,371

[22] Filed: Jul. 9, 1993

[51] Int. Cl.[5] ..... E04G 3/12

[52] U.S. Cl. ..... 182/45; 182/142; 248/237

[58] Field of Search ..... 182/45, 142; 248/237

[56] References Cited

U.S. PATENT DOCUMENTS

| | | | |
|---|---|---|---|
| 15,390 | 7/1856 | Rodefer | 182/45 |
| 380,395 | 4/1888 | Kramer | 248/237 X |
| 2,231,560 | 2/1941 | Campion | 182/45 X |
| 3,526,296 | 9/1970 | Stevens | 182/45 |
| 3,606,226 | 9/1971 | Bell, Sr. | 248/237 |
| 4,398,620 | 8/1983 | Townsend | 182/45 |

FOREIGN PATENT DOCUMENTS

| | | | |
|---|---|---|---|
| 610173 | 10/1960 | Italy | 182/45 |

*Primary Examiner*—Alvin C. Chin-Shue
*Attorney, Agent, or Firm*—Leon Gilden

[57] ABSTRACT

A scaffold is arranged for temporary mounting to a canted roof to include an anchor bracket arranged for positioning to the roof peak, wherein a base platform pivotally mounts a support platform to orient the support platform in a horizontal alignment relative to the associated roof surface employing arcuate first and second legs mounted to a rear edge of the platform adjustably directed through sleeve members in fixed securement to the support platform.

4 Claims, 5 Drawing Sheets

ADJUSTABLE ROOFING SCAFFOLD APPARATUS

BACKGROUND OF THE INVENTION

1. Field of the Invention

The field of invention relates to roof scaffold apparatus, and more particularly pertains to a new and improved adjustable roofing scaffold apparatus wherein the same is arranged for horizontally aligning a support platform to position an individual in horizontal alignment overlying a roof surface.

2. Description of the Prior Art

Roof scaffold apparatus of various types have been employed in the prior art, such as exemplified in the U.S. Pat. Nos. 4,972,922 and 4,856,745.

The instant invention attempts to overcome deficiencies of the prior art by providing for a support platform structure arranged for ease of manipulation relative to an underlying platform base that in turn is rotatably mounted about a surface of the associated roof and in this respect, the present invention substantially fulfills this need.

SUMMARY OF THE INVENTION

In view of the foregoing disadvantages inherent in the known types of scaffold apparatus now present in the prior art, the present invention provides an adjustable roofing scaffold apparatus wherein the same is directed to the horizontal orientation of a support platform for an individual working upon a roof surface. As such, the general purpose of the present invention, which will be described subsequently in greater detail, is to provide a new and improved adjustable roofing scaffold apparatus which has all the advantages of the prior art scaffold apparatus and none of the disadvantages.

To attain this, the present invention provides a scaffold arranged for temporary mounting to a canted roof to include an anchor bracket arranged for positioning to the roof peak, wherein a base platform pivotally mounts a support platform to orient the support platform in a horizontal alignment relative to the associated roof surface employing arcuate first and second legs mounted to a rear edge of the platform adjustably directed through sleeve members in fixed securement to the support platform.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable roofing scaffold apparatus which has all the advantages of the prior art scaffold apparatus and none of the disadvantages.

It is another object of the present invention to provide a new and improved adjustable roofing scaffold apparatus which may be easily and efficiently manufactured and marketed.

It is a further object of the present invention to provide a new and improved adjustable roofing scaffold apparatus which is of a durable and reliable construction.

An even further object of the present invention is to provide a new and improved adjustable roofing scaffold apparatus which is susceptible of a low cost of manufacture with regard to both materials and labor, and which accordingly is then susceptible of low prices of sale to the consuming public, thereby making such adjustable roofing scaffold apparatus economically available to the buying public.

Still yet another object of the present invention is to provide a new and improved adjustable roofing scaffold apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
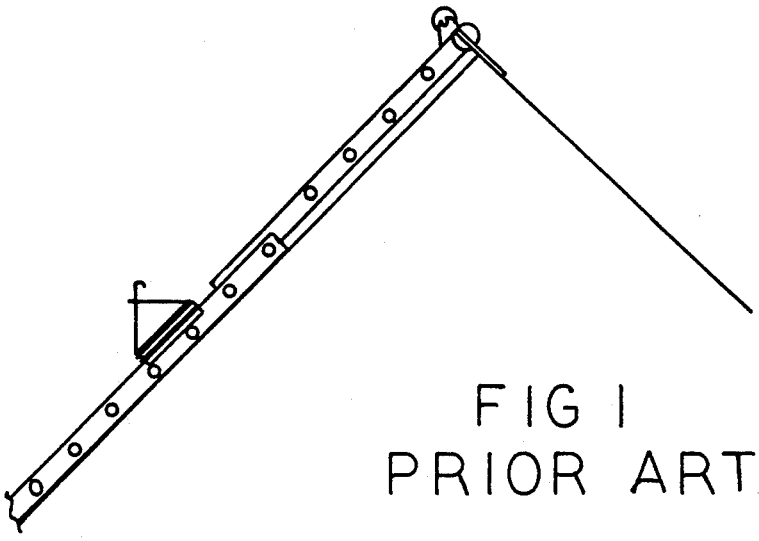
FIG 1 PRIOR ART
FIG. 1 is an orthographic view of a prior art scaffold structure.

With reference now to the drawings, and in particular to FIGS. 1 to 9 thereof, a new and improved adjustable roofing scaffold apparatus embodying the principles and concepts of the present invention and generally designated by the reference numeral 10 will be described.

The FIG. 1 indicates a prior art structure, as set forth in U.S. Pat. No. 4,972,922, indicating a carriage member arranged for traversing a roof surface.

Figure 2:
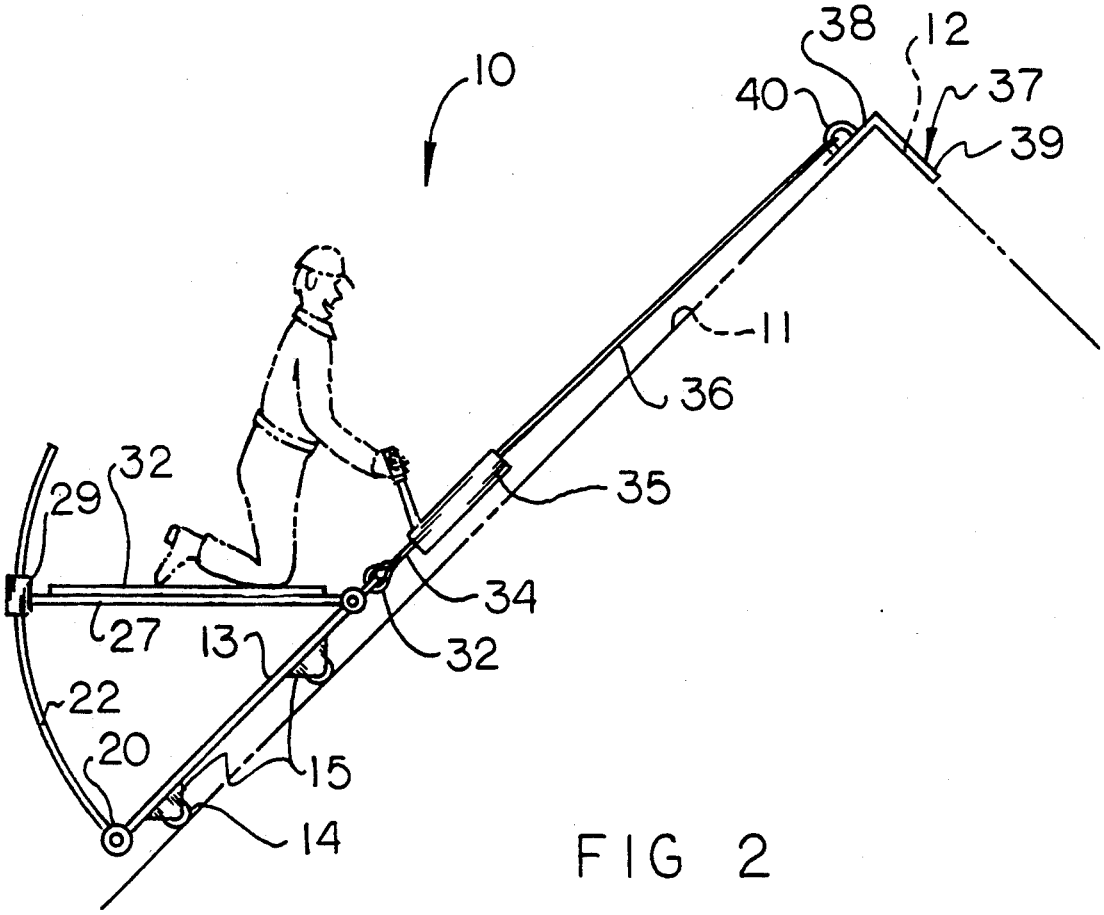
FIG. 2 is an orthographic side view of the invention.
Figure 3:
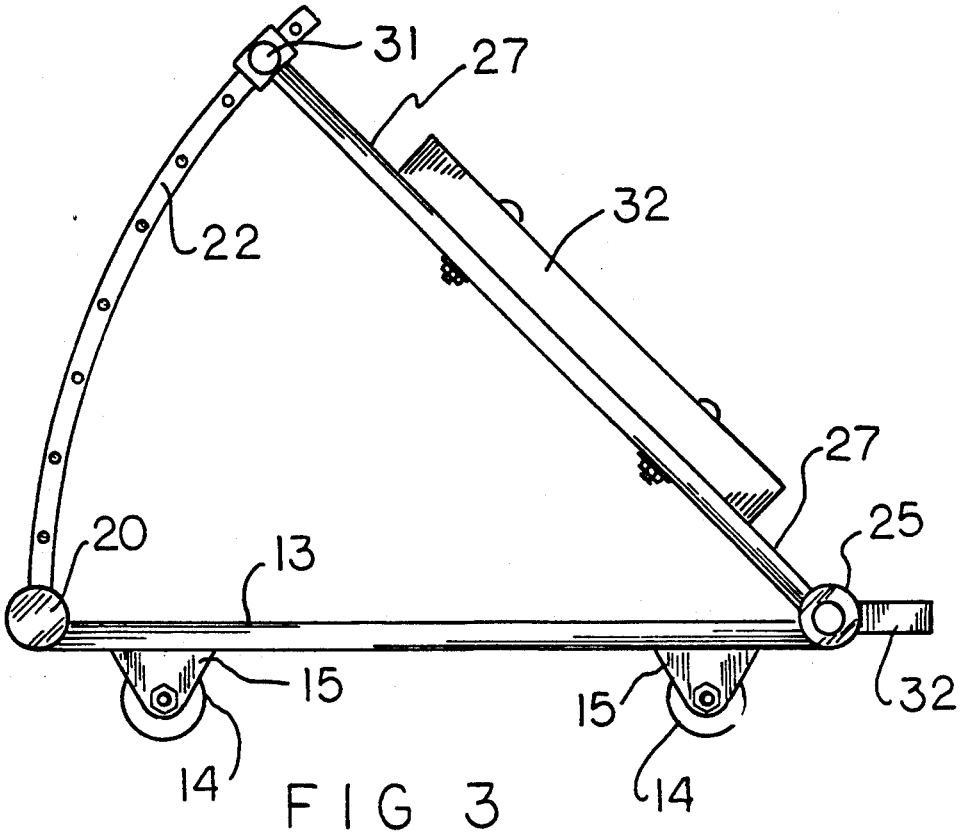
FIG. 3 is an enlarged orthographic view of the carriage structure of the invention.
Figure 4:
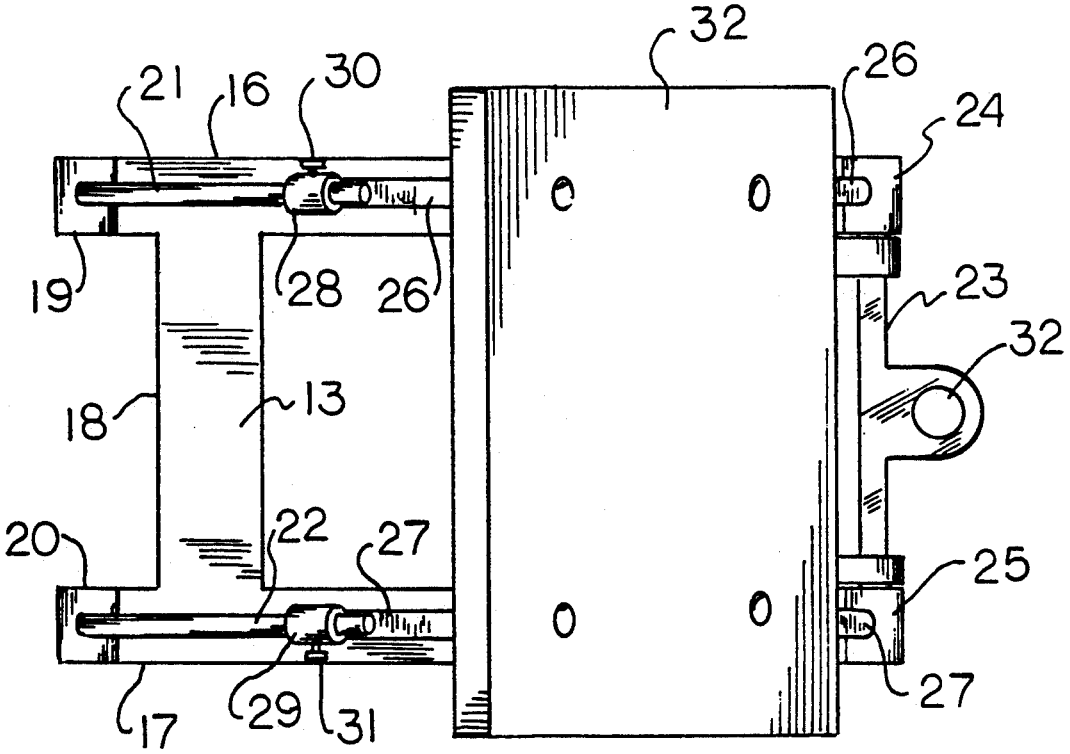
FIG. 4 is an orthographic top view of the carriage structure as set forth in FIG. 3.
Figure 5:
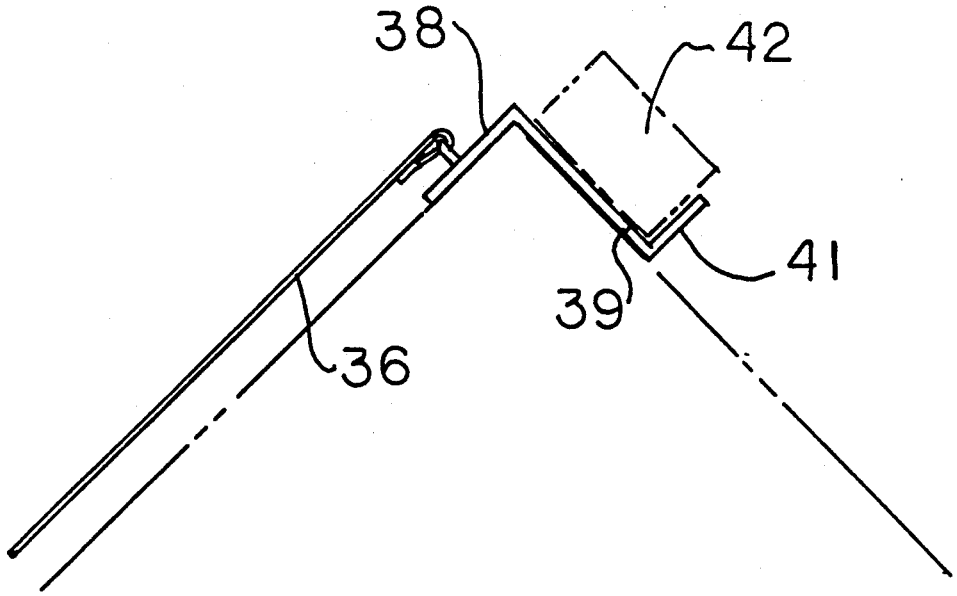
FIG. 5 is an orthographic view of a modified anchor bracket employed by the invention.

More specifically, the adjustable roofing scaffold apparatus 10 of the instant invention essentially comprises mounting overlying a roof surface 11 having a roof peak 12, as illustrated in FIG. 2 for example. The apparatus includes a rigid base platform 13 having plural pairs of resilient wheel members 14, each rotatably mounted to a wheel member support 15 that in turn has the supports 15 fixedly mounted to a bottom surface of the base platform 13. The resilient wheel members 14 are provided to minimize damage to the roof surface 11 of the organization in use.

The base platform 13 includes a base platform first side 16 spaced from a base platform second side 17, a base platform rear edge 18, and a base platform front edge 23. Respective first and second hinges 19 and 20 that are coaxially aligned relative to one another are mounted to the base platform rear edge 18, with the first hinge 19 adjacent the first side 16 and the second hinge 20 adjacent the second side 17. Respective first and second rigid arcuate legs 21 and 22 are fixedly mounted to the respective first and second hinges 19 and 20. The first and second arcuate legs 21 and 22 are parallel and coextensive relative to one another, having a radius equal to a predetermined length. The base platform front edge 23 includes respective third and fourth hinges 24 and 25 that are coaxially aligned relative to one another mounting respective third and fourth longitudinally aligned legs 26 and 27 that are arranged in a parallel coextensive relationship relative to one another, each having a length equal to said predetermined length. Respective third and fourth sleeves 28 and 29 are mounted to respective third and fourth legs 26 and 27, with a first fastener rod 30 threadedly directed through the third sleeve 28 and a second fastener rod 31 threadedly directed through the fourth sleeve 29, wherein the fastener rods 30 and 31 are arranged for respective engagement with the respective first and second arcuate legs 21 and 22 to fixedly secure the respective arcuate legs within the respective sleeves to angularly orient the sleeves along the arcuate legs in an adjustable manner. A rigid support platform 32 is fixedly mounted to the third and fourth legs 26 and 27 extending over the third and fourth legs. A support opening 33 is mounted medially of the base platform front edge 23 to secure a first tether line 34 that extends to a winch member 35 that may be of a "come-a-long" configuration, wherein such come-a-long structure is well known in the art in a winching procedure. A second tether line 36 extends from the winch member 35 to the anchor bracket 37 that is positioned upon the roof peak 12. The anchor bracket 37 includes respective first and second plates 38 and 39 fixedly and orthogonally mounted relative to one another to receive the roof peak 12 within the anchor bracket 37. An anchor bracket loop 40 mounted to the first plate 38 receives a forwardmost end of the second tether line 36. The FIG. 5 indicates the use of a modified anchor bracket structure, that in addition to the first and second plates 38 and 39, a third plate 41 is orthogonally and fixedly mounted to the second plate 39 projecting above the second plate in a parallel relationship relative to the first plate, wherein a ballast block 42 is positioned upon the second plate 39 in abutment with the third plate 41 to minimize slippage and enhanced positioning of the anchor bracket 37 to the roof peak 12.

Figure 6:
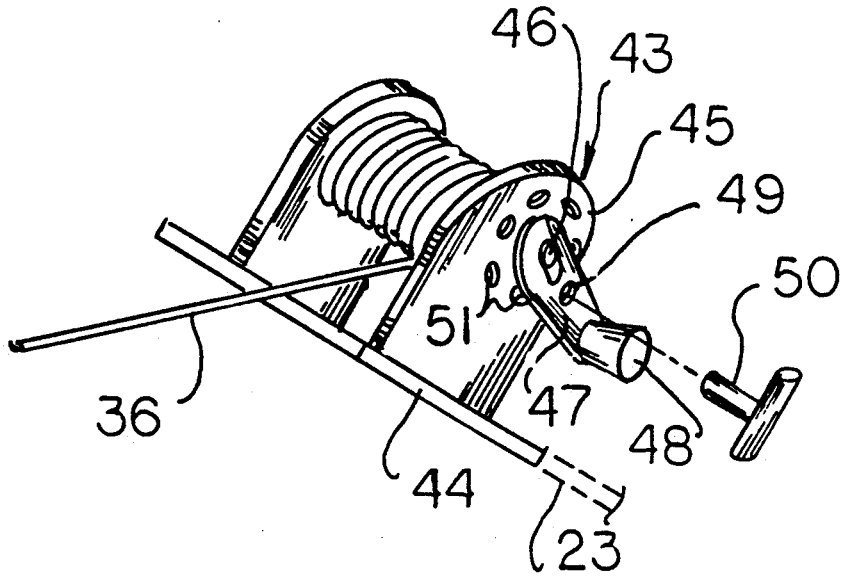
FIG. 6 is an isometric illustration of a modified winch structure employed by the invention.

The FIG. 6 indicates the use of a modified winch member that may be employed by the invention, wherein the winch member 43 includes a winch member plate 44 fixedly secured to the base platform front edge 23, and the winch member plate 44 includes a plurality of spaced parallel supports 45 rotatably mounting an axle 46 therebetween. A crank 47 is mounted to the axle 46 in an orthogonal relationship, with a crank handle 48 rotatably mounted to the crank 47 spaced from the axle 46. The tether line 36 in this relationship is wound about the axle 46 between the supports 45. A crank aperture 49 spaced from the axle a predetermined distance is arranged to receive a lock pin 50 therethrough, wherein an annular array of lock apertures 51 directed through one of the supports 45 in adjacency to the crank 47 is spaced from the axle 46 a radius equal to the predetermined distance. The annular array of lock apertures 51 in this manner are concentric about the axle 46 and in this manner, one of the apertures 51 receives the lock pin 50 subsequent to its projection through the crank aperture 49 to insure locking of the crank 47 relative to the one support 45.

Figure 7:
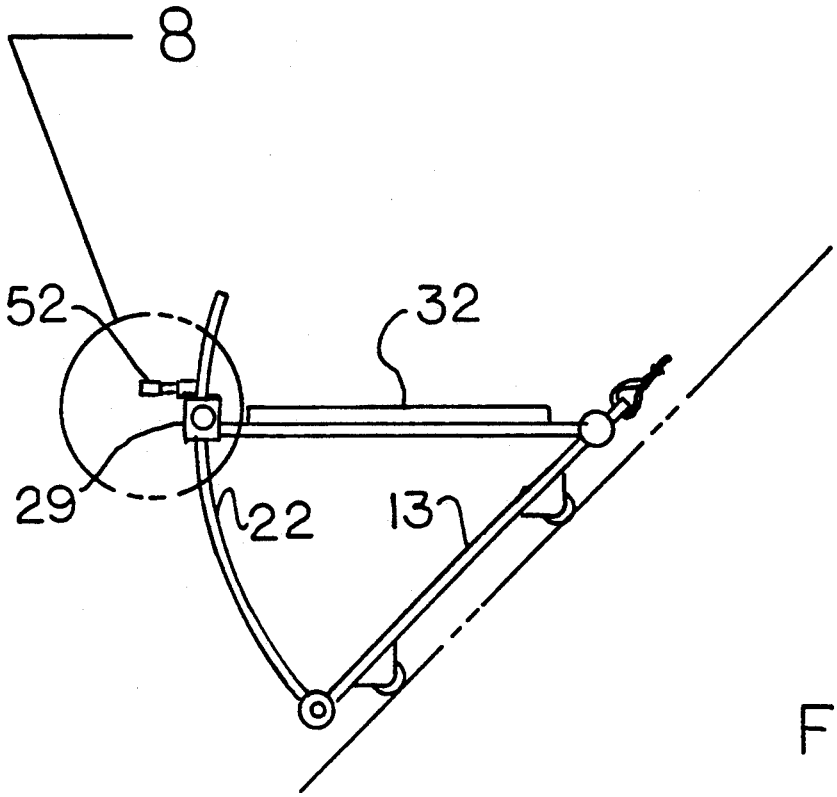
FIG. 7 is an orthographic view of the carriage structure employing a spirit level.
Figure 8:
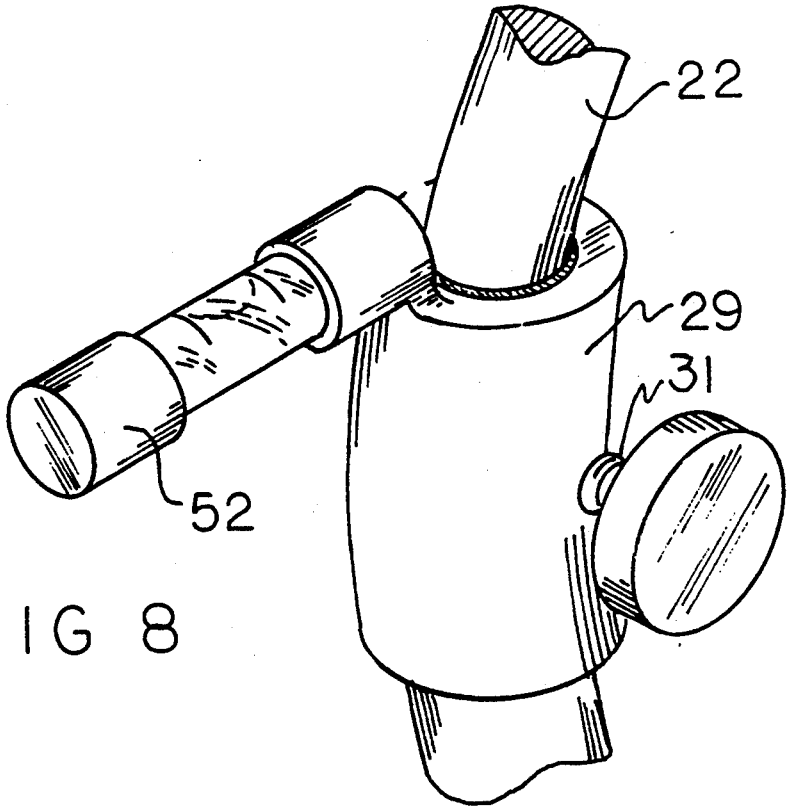
FIG. 8 is an enlarged isometric illustration of section 8 as set forth in FIG. 7.

The FIGS. 7 and 8 indicates the use of a spirit level 52 fixedly mounted to at least one of the sleeves, such as the fourth sleeve 29. The spirit level 52 is arranged to assist in the leveling of the support platform 27 and accordingly the spirit level 52 is arranged parallel to the support platform 27 to assist in its horizontal alignment relative to the roof surface 11.

Figure 9:
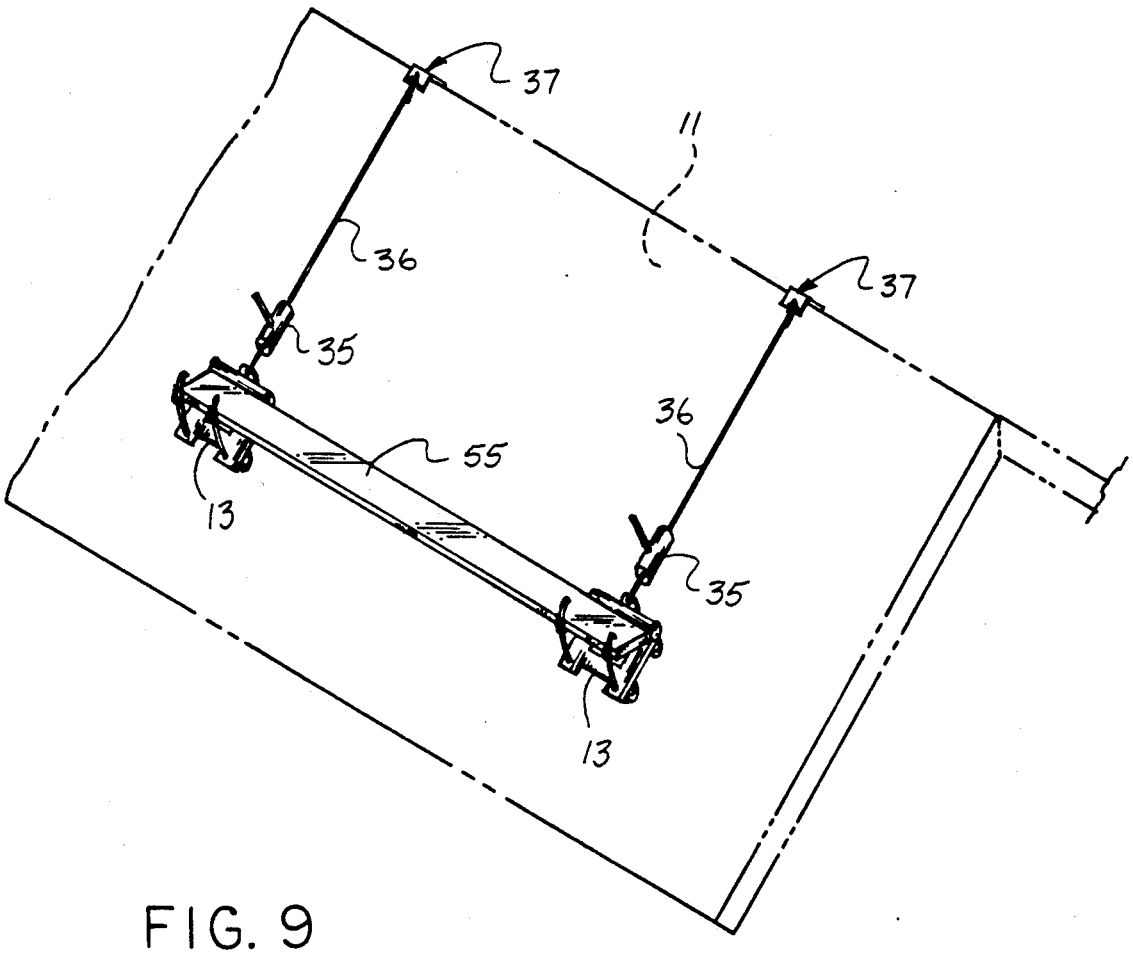
FIG. 9 is an isometric illustration of a plurality of the scaffolds having an interconnecting plank therebetween.

The FIG. 9 indicates a plurality of scaffolds having an intersecting plank 55 therebetween, as the plank is mounted and positioned upon the respective platform 32 of each of the scaffolds, such that a plurality of individuals, as well as materials and the like, may be mounted in a reciprocating fashion relative to the roof structure, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable roofing scaffold apparatus arranged for mounting to a roof, having a roof surface and a roof peak, wherein the apparatus comprises, a scaffold including a rigid base platform having a first side spaced from a second side, a front edge spaced from a rear edge, and a first hinge and a second hinge, each mounted to the rear edge, with the first hinge and the second hinge arranged in a coaxially aligned relationship, with the first hinge positioned in adjacency to the first side and the second hinge positioned in adjacency to the second side, and a first rigid arcuate leg fixedly mounted to the first hinge, and a second rigid arcuate leg fixedly mounted to the second hinge, with the first and second rigid arcuate legs arranged in a spaced, parallel coextensive relationship relative to one another, each having a radius equal to a predetermined length, and a third hinge and a fourth hinge arranged in a coaxially aligned relationship mounted to the front edge, with the third hinge positioned in adjacency to the first side and the fourth hinge positioned in adjacency to the second side, with the third hinge including a third leg, and the fourth hinge including a fourth leg, and the third leg and the fourth leg arranged in a parallel coextensive relationship relative to one another equal to said predetermined length, and first securement means mounted to the third leg for securement to the first leg, and second securement means mounted to the fourth leg for securement to the second leg, and the first securement means includes a third leg sleeve fixedly mounted to the third leg slidably receiving the first leg therethrough, wherein the third leg sleeve includes a first fastener rod threadedly directed to the third leg sleeve arranged for abutment with the first leg, and the fourth leg having a fourth leg sleeve fixedly mounted to the fourth leg arranged for sliding reception of the second leg therethrough, with the fourth leg sleeve having a second fastener rod threadedly directed through the fourth leg sleeve arranged for abutment with the second leg, and a support platform fixedly mounted to the third leg and the fourth leg extending over the third leg and the fourth leg, and an anchor bracket arranged for mounting to the roof peak, and the anchor bracket having a first plate orthogonally and fixedly secured to a second plate, wherein the first plate and the second plate receive the roof peak therebetween, and the first plate includes an anchor bracket loop, and a tether line member mounted to the anchor bracket line loop extending from the anchor bracket, and a winch member receiving the tether line member, and the winch member secured relative to the base platform front edge, and the base platform having a plurality of wheel member supports fixedly mounted to the base platform, wherein the wheel member supports are mounted to a bottom surface of the base platform, and each of the wheel member supports includes a resilient wheel member rotatably mounted within each of the wheel member supports, and the anchor bracket second plate further includes a third plate fixedly and orthogonally mounted to the second plate parallel to the first plate, and a ballast block arranged for positioning upon the second plate and the third plate to enhance engagement of the anchor plate with the roof peak.

2. An apparatus as set forth in claim 1 wherein the winch member includes a winch member plate fixedly secured to the base platform front edge, and spaced parallel supports mounted to the winch plate, and an axle rotatably mounted through the supports, and an axle fixedly mounted to the axle in an orthogonally relationship positioned in adjacency relative to one of the supports, wherein the axle includes a handle orthogonally mounted to the axle crank parallel to the axle in a spaced relationship relative to the axle, and the axle crank includes a crank aperture spaced from the axle a predetermined distance, and a lock pin arranged from reception through the crank aperture, and an annular array of lock aperture concentric about the axle directed through said one of the supports, and each of the lock apertures are spaced from the axle said predetermined distance.

3. An apparatus as set forth in claim 2 including a spirit level fixedly mounted to the fourth leg sleeve, with the spirit level arranged relative to the support platform.

4. An apparatus as set forth in claim 3 including a further scaffold, said further scaffold positioned in adjacency to said scaffold and having a plank extending therebetween said scaffold and said further scaffold, wherein said plank is mounted upon said support platform of said scaffold, and wherein said further scaffold includes a further support platform fixedly receiving said plank, and said further scaffold including a further anchor bracket arranged for mounting to said roof and a further tether line extending from said anchor bracket to said further scaffold.

* * * * *